US010418715B2

(12) United States Patent
Tai

(10) Patent No.: US 10,418,715 B2
(45) Date of Patent: Sep. 17, 2019

(54) TUNABLE ANTENNA MODULE USING FREQUENCY-DIVISION CIRCUIT FOR MOBILE DEVICE WITH METAL COVER

(71) Applicant: MEDIATEK INC., Hsin-Chu (TW)

(72) Inventor: Chen-Fang Tai, New Taipei (TW)

(73) Assignee: MEDIATEK INC., Hsin-Chu (TW)

( * ) Notice: Subject to any disclaimer, the term of this patent is extended or adjusted under 35 U.S.C. 154(b) by 0 days.

(21) Appl. No.: 15/877,399

(22) Filed: Jan. 23, 2018

(65) Prior Publication Data

US 2018/0145418 A1 May 24, 2018

Related U.S. Application Data

(63) Continuation of application No. 14/965,819, filed on Dec. 10, 2015, now Pat. No. 9,912,066.

(60) Provisional application No. 62/188,130, filed on Jul. 2, 2015.

(51) Int. Cl.

| | |
|---|---|
| ***H01Q 13/10*** | (2006.01) |
| ***H01Q 1/24*** | (2006.01) |
| ***H01Q 5/314*** | (2015.01) |

(52) U.S. Cl.

CPC ..... *H01Q 13/10* (2013.01); *H01Q 1/243* (2013.01); *H01Q 5/314* (2015.01)

(58) Field of Classification Search

CPC ..... H01Q 13/10; H01Q 5/314; H01Q 1/243

See application file for complete search history.

(56) References Cited

U.S. PATENT DOCUMENTS

| | | | | |
|---|---|---|---|---|
| 2011/0116423 | A1 | 5/2011 | Rousu | |
| 2013/0016633 | A1* | 1/2013 | Lum | H04B 1/0057 370/277 |
| 2013/0250819 | A1 | 9/2013 | Khlat | |
| 2014/0087668 | A1 | 3/2014 | Mow | |
| 2014/0266938 | A1 | 9/2014 | Ouyang | |
| 2014/0306857 | A1 | 10/2014 | Bevelacqua | |

FOREIGN PATENT DOCUMENTS

| | | | |
|---|---|---|---|
| CN | 1538556 | A | 10/2004 |
| CN | 102739265 | A | 10/2012 |
| CN | 104064865 | A | 9/2014 |
| CN | 104752833 | A | 7/2015 |
| EP | 1248317 | A1 | 10/2002 |
| EP | 2251930 | A1 | 11/2010 |
| GB | 2349982 | B | 1/2004 |
| KR | 10-2013-0125578 | A | 11/2013 |
| WO | 2014114843 | A1 | 7/2014 |

* cited by examiner

*Primary Examiner* — Hoang V Nguyen
(74) *Attorney, Agent, or Firm* — Winston Hsu

(57) ABSTRACT

A tunable antenna module for a mobile device includes an antenna, a frequency-division circuit and one or more impedance-tuning circuits. The frequency-division circuit is coupled to a radiator of the antenna for forming one or more signal paths for one or more of component frequencies of a radio-frequency signal of the antenna. One or more the impedance-tuning circuits are coupled to the frequency-division circuit for tuning an impedance of the antenna at one or more of the component frequencies of the radio-frequency signal.

18 Claims, 11 Drawing Sheets

TUNABLE ANTENNA MODULE USING FREQUENCY-DIVISION CIRCUIT FOR MOBILE DEVICE WITH METAL COVER

CROSS REFERENCE TO RELATED APPLICATION

This application is a continuation of U.S. application Ser. No. 14/965,819, filed on Dec. 10, 2015, which claims the benefit of U.S. Provisional Application No. 62/188,130, filed on Jul. 2, 2015 and entitled "LTE-A Carrier Aggregation ANT structure for Full Metal Mobile Device", the contents of which are incorporated herein.

BACKGROUND

Toward advanced high-speed wireless communication system, such as transmitting data in a higher peak data rate, the Long-Term Evolution Advanced (LTE-A) system is standardized by the 3rd Generation Partnership Project (3GPP) as an enhancement of the Long-Term Evolution (LTE) system. The LTE-A system targets faster switching between power states, improves performance at the cell edge, and includes subjects, such as bandwidth extension, coordinated multipoint transmission/reception (COMP), uplink multiple input multiple output (MIMO), etc.

For bandwidth extension, carrier aggregation (CA) is introduced to the LTE-A system, where two or more component carriers are aggregated for supporting wider transmission bandwidths and for spectrum aggregation. By implementing carrier aggregation, multiple component carriers are aggregated into overall wider bandwidth, where a user equipment (UE) or mobile device may establish multiple links corresponding to the multiple component carriers for simultaneously receiving and transmitting radio signals. In practice, the mobile device simultaneously operates in two or more frequency bands to achieve carrier aggregation.

Please refer to FIG. 1, which illustrates a spectrum of operating frequency bands utilized in the LTE-A system according to the prior art. As shown in FIG. 1, low frequency bands LB1-LB3 are ranged from 700 MHz to 900 MHz, a medium frequency band MB is ranged from 1800 MHz to 2100 MHz, and a high frequency band HB is ranged from 2300 MHz to 2600 MHz. The mobile device requires single frequency band if operating in a non-CA mode, and requires two or more frequency bands if operating in a CA mode such as modes CA1, CA2 and CA3 for different geographical areas and countries. For example, the frequency bands LB1 and MB are required to operate in the mode CA1, the frequency bands LB2 and MB are required to operate in the mode CA2, and the frequency bands LB3 and MB are required to operate in the mode CA3.

In addition, there is a trend of equipping the mobile device with a metal cover or a metal frame for industrial design and robustness, which may cause decreased antenna gain, narrowed bandwidth or unstable antenna performance due to the metal housing or frame when an antenna is integrated in the mobile device. In that situation, a designer not only faces a challenge of the antenna performance but also integration difficulty between the antenna and the metal cover.

To solve this issue, one of the conventional solutions is to distinctly design, antennas with separate stock keeping unit (SKU) for supporting the modes CA1, CA2 and CA3, which increases production cost and stock management efforts. Another conventional solution is to utilize a tunable antenna module including an antenna and a switch circuit in the mobile device, where the switch circuit is used for switching operating frequencies of the antenna to operate in the modes CA1-CA3 and the non-CA mode. However, the switch circuit causes second and/or third harmonic spur to interfere receiving signals of the antenna, in which the second and/or third harmonic spur of transmitting signals are reflected by the switch circuit such that the reflected signals are received by the antenna.

For example, in a case of one uplink with a carrier frequency (e.g., 704 MHz-716 MHz) and two downlinks in the medium frequency band MB (e.g., 1800 MHz to 2200 MHz) are established for the mode CA1, the second and/or third harmonic spur of the transmitting signals (e.g., 1408 MHz-2112 MHz) may interfere the receiving signals in the medium frequency band MB to reduce a signal-to-noise ratio of the receiving signals.

Therefore, how to improve the bandwidth and mitigate the harmonic interference to support carrier aggregation for the antenna integrated with the metal cover has become a goal in the industry.

SUMMARY

It is therefore an objective of the present invention to provide a tunable antenna module using frequency-division circuit for mobile device with metal cover to solve the above mentioned issues.

The present invention discloses a tunable antenna module for a mobile device. The tunable antenna module includes an antenna, a frequency-division circuit and one or more impedance-tuning circuits. The antenna includes a feed point for feeding a radio-frequency signal, and a radiator coupled to the feed point for resonating the radio-frequency signal. The frequency-division circuit coupled to the radiator for forming one or more signal paths for one or more of component frequencies of the radio-frequency signal. One or more the impedance-tuning circuits are coupled to the frequency-division circuit for tuning an impedance of the antenna at one or more of the component frequencies of the radio-frequency signal.

The present invention further discloses a mobile device includes a signal processing module and a tunable antenna module. The signal processing module is used for generating a radio-frequency signal to the tunable antenna module. The tunable antenna module is coupled to the signal processing module, and includes an antenna, a frequency-division circuit and one or more impedance-tuning circuits. The antenna includes a feed point for feeding a radio-frequency signal, and a radiator coupled to the feed point for resonating the radio-frequency signal. The frequency-division circuit coupled to the radiator for forming one or more signal paths for one or more of component frequencies of the radio-frequency signal. One or more the impedance-tuning circuits are coupled to the frequency-division circuit for tuning an impedance of the antenna at one or more of the component frequencies of the radio-frequency signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
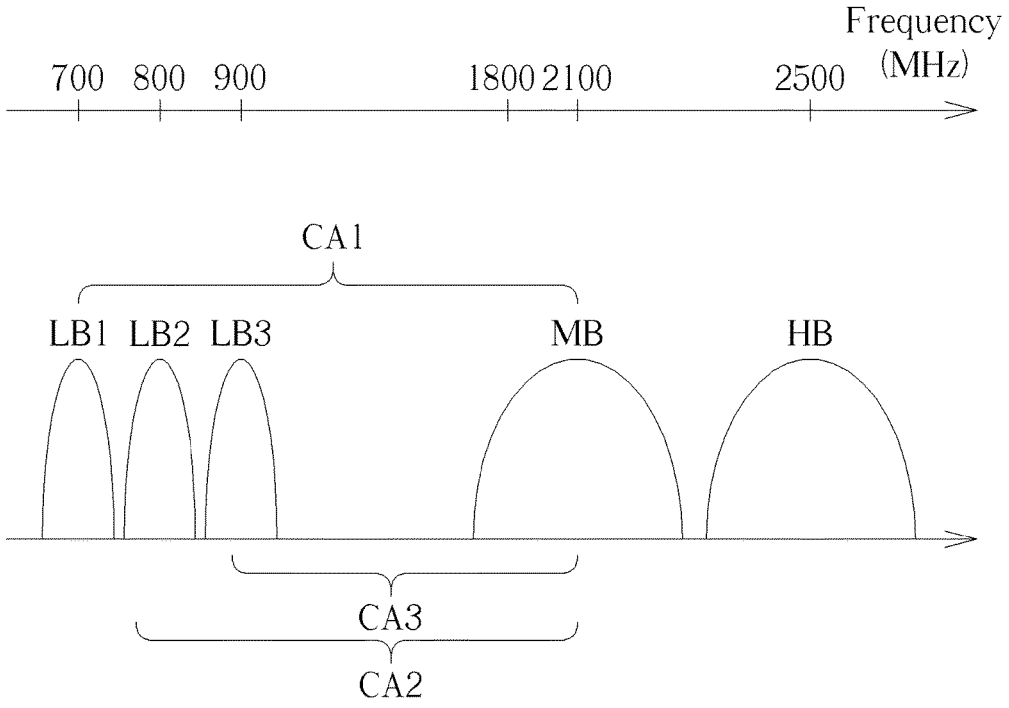
FIG. 1 RELATED ART
FIG. 1 illustrates a spectrum of operating frequency bands utilized in the LTE-A system.
Figure 2:
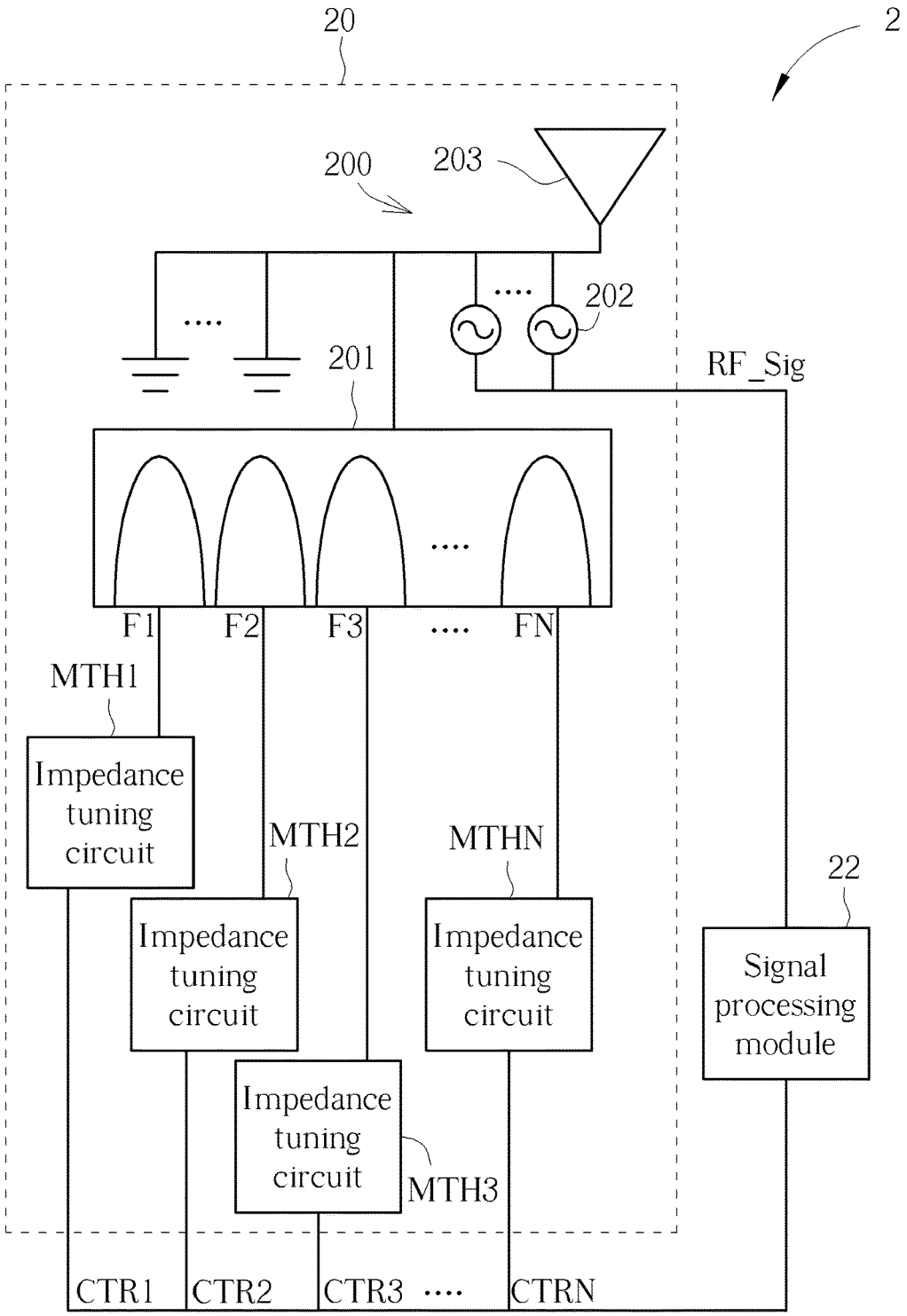
FIG. 2 is a functional diagram of a mobile device according to an embodiment of the present invention.

Please refer to FIG. 2, which is a functional diagram of a mobile device 2 according to an embodiment of the present invention. The mobile device 2 includes a tunable antenna module 20 and a signal processing module 22. The signal processing module 22 may be used for generating a radio-frequency signal RF_sig to the tunable antenna module 20 to be radiated by the tunable antenna module 20, and processing wireless signals received by the tunable antenna module 20, so as to achieve wireless communication. The tunable antenna module 20 includes an antenna 200, a frequency-division circuit 201 and impedance-tuning circuits MTH1-MTHN.

The antenna 200 may be used for signal transmission by resonating the radio-frequency signal RF_sig, and for signal reception inducing wireless signals in the air. The antenna 200 includes a feed point 202 and a radiator 203. In one embodiment, the antenna 200 may include multiple feed points. The feed point 202 may be used for feeding the radio-frequency signal RF_sig to the radiator 203. The radiator 203 may be coupled to the feed point 202 and a ground for resonating the radio-frequency signal RF_sig, and inducing receiving signals to feed back to the signal processing module 22. The frequency-division circuit 201 may be coupled to the radiator 203 and the impedance-tuning circuits MTH1-MTHN, for forming signal paths for component frequencies F1-FN of the radio-frequency signal RF_sig between the radiator 203 and the impedance-tuning circuits MTH1-MTHN, respectively. The impedance-tuning circuits MTH1-MTHN may be coupled between the frequency-division circuit 201 and the signal processing module 22, for tuning an impedance of the antenna 200 at one or more of the component frequencies F1-FN according to control signals CTR1-CTRN generated by the signal processing module 22, respectively.

One or more of the component frequencies F1-FN may pass through the frequency-division circuit 201 while noise signals such as second and/or third harmonic spur of transmitting signals may be attenuated or blocked by the frequency-division circuit 201, so that the impedance of the antenna 200 at one or more of the component frequencies F1-FN may be selectively adjusted by one or more of the impedance-tuning circuits MTH1-MTHN. By adjusting the impedance of the antenna 200 at one or more component frequencies F1-FN, the bandwidth of the antenna 200 may be effectively increased to support carrier aggregation.

The mobile device 2 may operate in mode CA1, CA2 or, CA3, or non-CA mode. Take mode CA1 for example, the impedance of the antenna 200 may be adjusted to match with the frequency bands LB1 and MB and mismatch from unwanted frequency bands, i.e. the frequency bands LB2 and LB3, by one or more of the impedance-tuning circuits MTH1-MTHN.

In addition, the second and/or third harmonic spur of transmitting signals in the frequency band LB1 and other interference signals, e.g., the control signals CTR1-CTRN, baseband signals generated by the signal processing module 22, or noise signals from the mobile device 2 may be attenuated or blocked by the frequency-division circuit 201. As a result, receiving signals of the antenna 200 may not be interfered by harmonic spurs and noise signals, so as to reach a better signal-to-noise ratio.

In short, the tunable antenna module of the present invention utilizes the frequency-division circuit to form signal paths for one or more of component frequencies of the radio-frequency signal between the radiator and the impedance-tuning circuits, such that the impedance associated with one or more of the component frequencies may be selectively adjusted by the impedance-tuning circuits. Therefore, operating frequency bands of the mobile device can be switched to support the modes CA1-CA3 and the non-CA mode to save production cost and stock management efforts, and the receiving signals of the antenna may not be interfered by harmonic spurs and noise signals, so as to reach a better signal-to-noise ratio.

Figure 3:
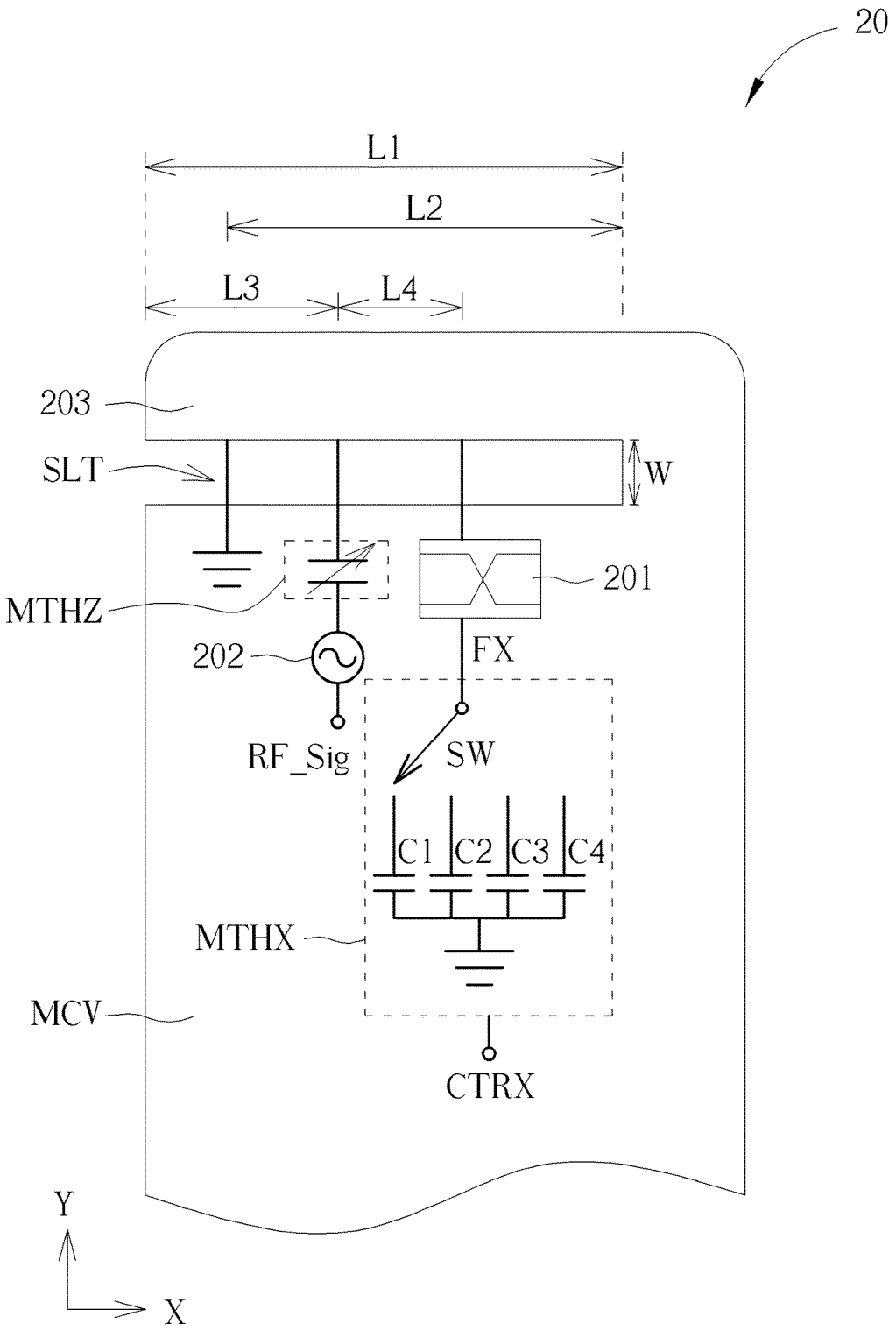
FIG. 3 is a schematic diagram of the tunable antenna module in FIG. 2 according to an embodiment of the present invention.
Figure 4B:
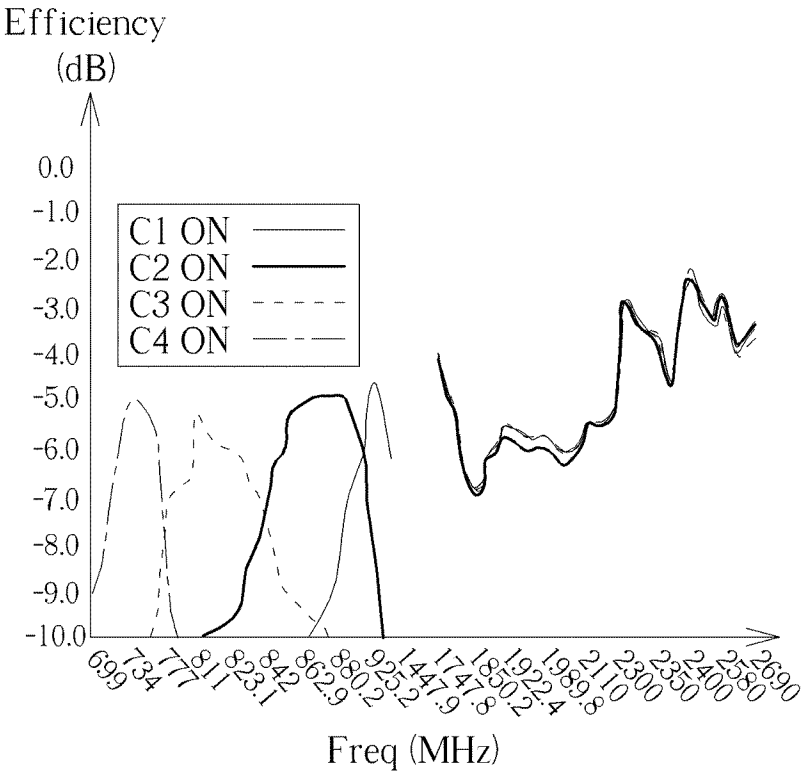
FIG. 4A to FIG. 4E and FIG. 5A to FIG. 5D illustrate curves of efficiency of the tunable antenna module based on various switching states of the impedance-tuning circuits in FIG. 3.
Figure 4A:
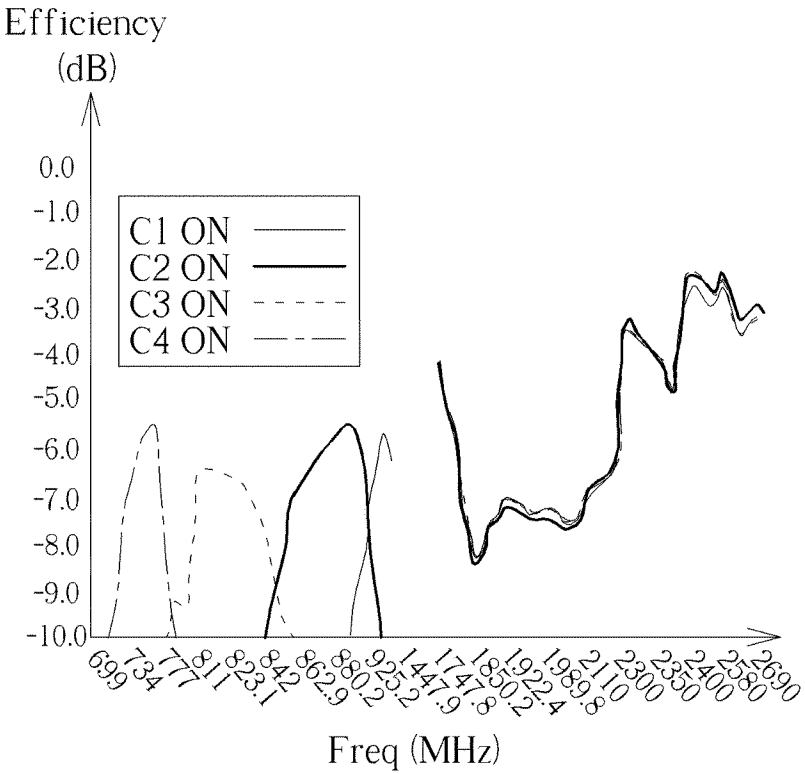
Figure 4D:
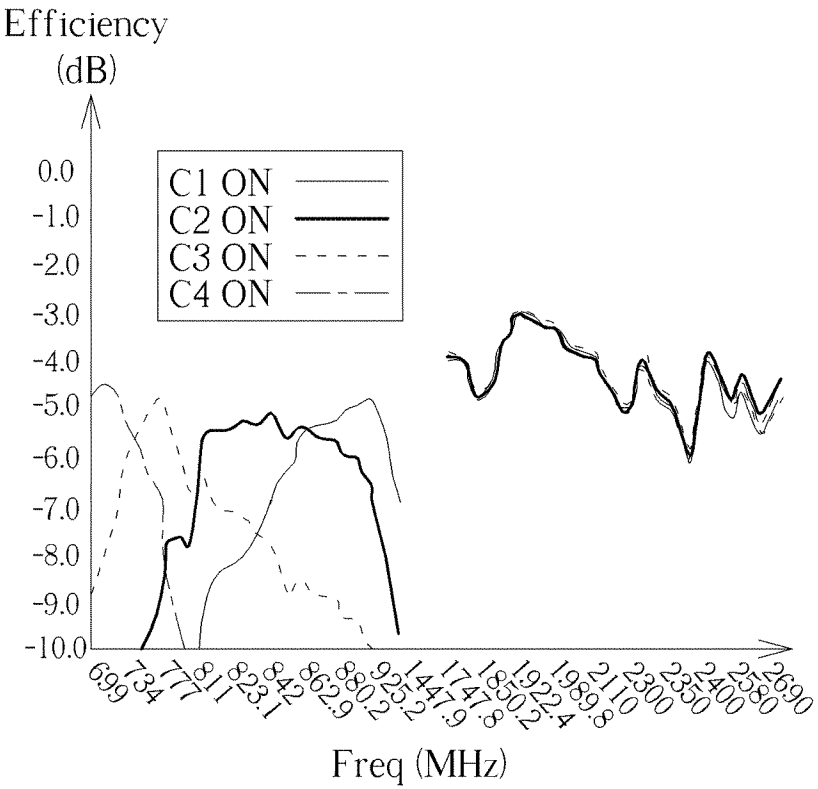
Figure 4C:
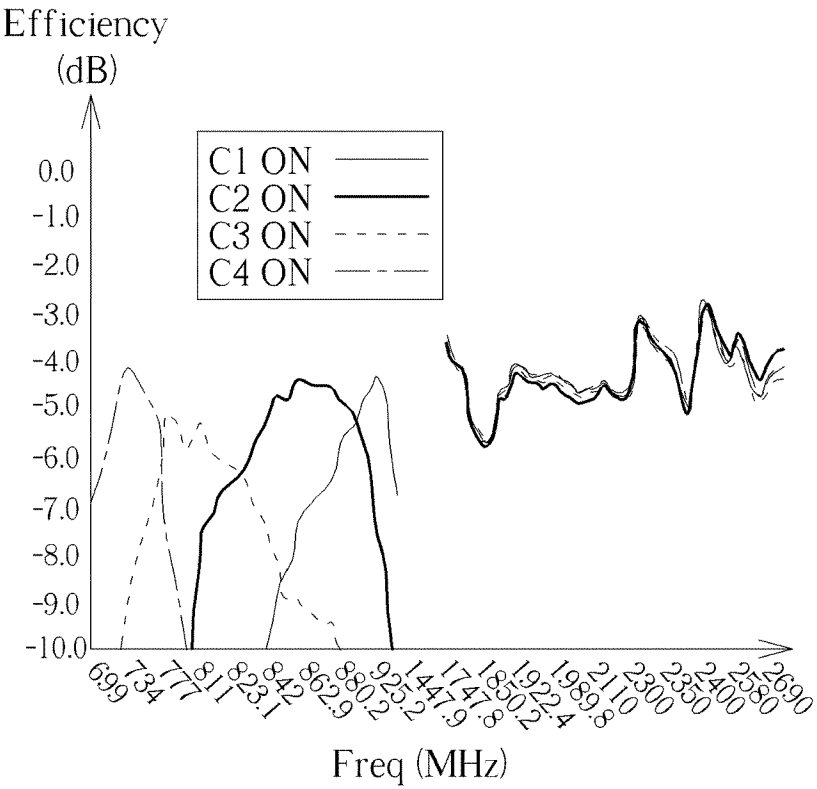
Figure 4E:
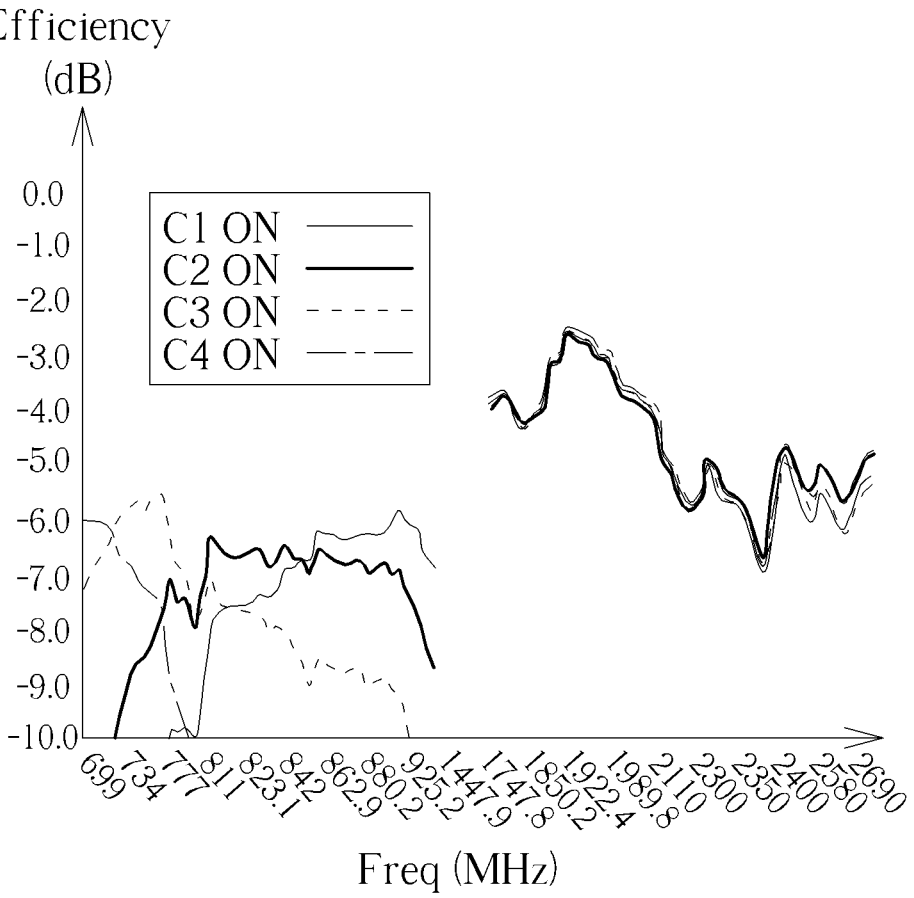
Figure 5A:
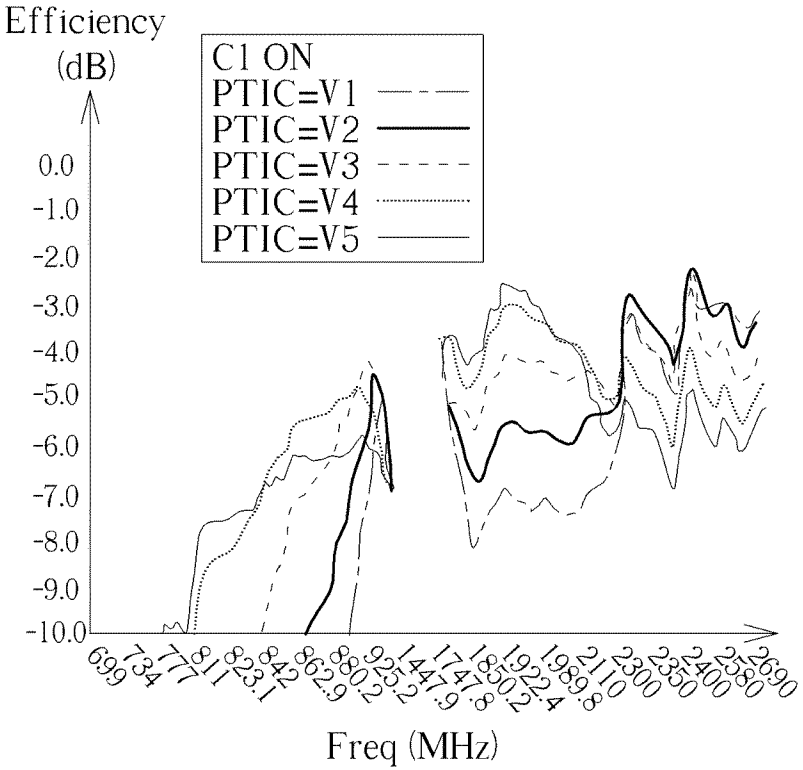
Figure 5B:
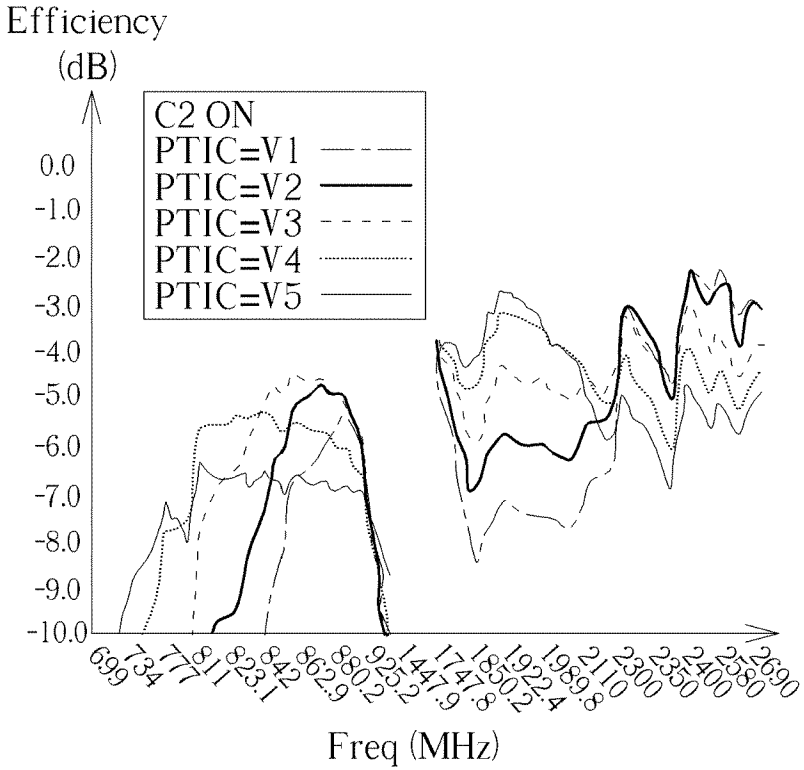
Figure 5D:
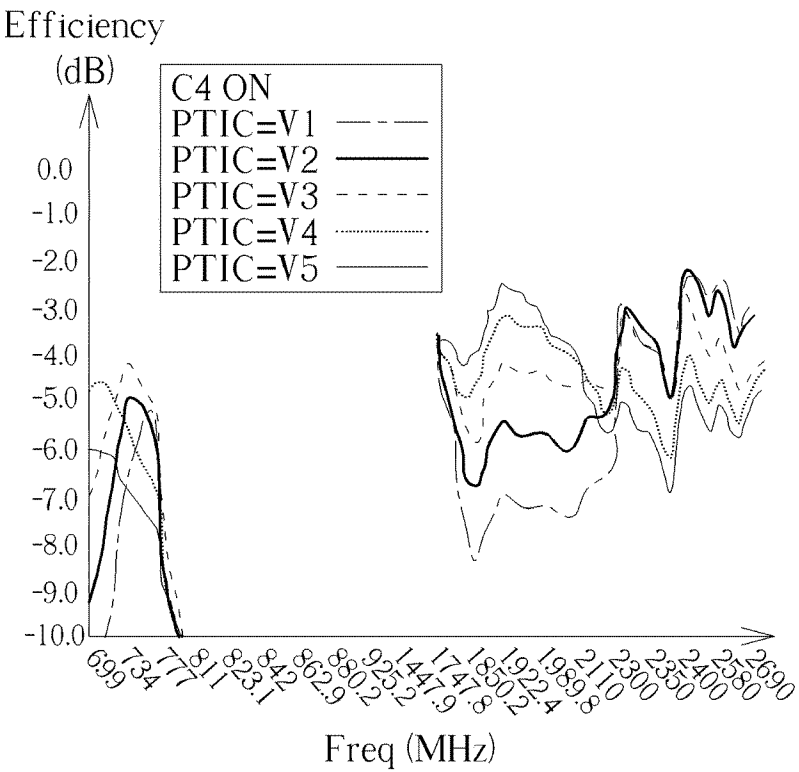
Figure 5C:
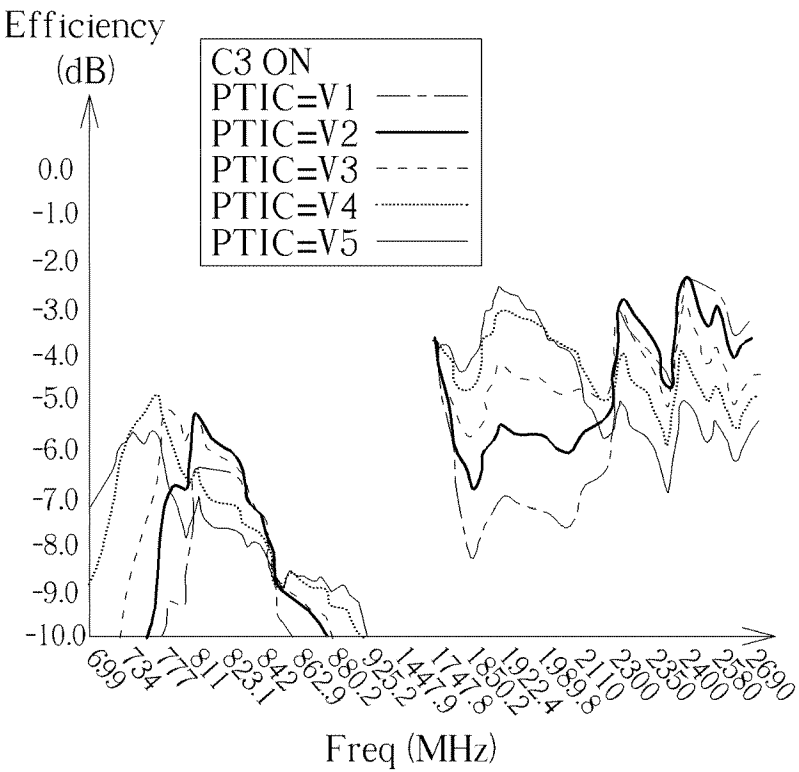

FIG. 3 is a schematic diagram of the tunable antenna module 20 according to an embodiment of the present invention. In FIG. 3, elements utilized in FIG. 2 are denoted with the same symbols, one of component frequencies F1-FN is denoted with FX, one of the impedance-tuning circuits MTH1-MTHN is denoted with MTHX, and one of the control signals CTR1-CTRN is denoted with CTRX.

The tunable antenna module 20 further includes an impedance-tuning circuit MTHZ coupled between the radiator 203 and the feed point 202 for tuning the impedance of the antenna 200 associated with the component frequency FX to match with an output impedance of the signal processing module 22. The impedance-tuning circuit MTHX includes a switch circuit SW and a tunable circuit including a capacitors C1-C4. The switch circuit SW may be coupled between the frequency-division circuit 201 and the tunable circuit for connecting the one of the capacitors C1-C4 with the frequency-division circuit 201 or separating the capacitors C1-C4 from the frequency-division circuit 201 according to the control signal CTRX, so that the impedance of the antenna 200 associated with the component frequency FX may be adjusted to match with the wanted frequency bands and mismatch from unwanted frequency bands. In one embodiment, the impedance-tuning circuit MTHZ may be a passive tunable integrated circuit (PTIC).

In such a structure, a signal path of the radio-frequency signal RF_sig from the signal processing module 22, passing through the feed point 202 to the radiator 203 may be well-matched to reach a better antenna performance at the component frequency FX.

Further, the tunable antenna module 20 may be integrated with a metal cover MCV of the mobile device 2 to cater to the trend of equipping with a metal housing or a metal frame for decoration and robustness. The radiator 203 and an open slot SLT may be formed in the metal cover MCV. A portion of the metal cover MCV may be used as the radiator 203 and another portion of the metal cover MCV may be used as aground, and the radiator 203 and the ground may be separated by the open slot SLT.

The radiator 203 may extend along a direction X, and the radiator 203 includes a ground point for connecting the radiator 203 with the ground formed on the metal cover. In one embodiment, the radiator 203 may include multiple ground points according to practical requirements. The open slot SLT has a length L1 along the direction X and a width W along a direction Y, where the direction X is perpendicular to the direction Y. A length L2 from where the ground point toward the direction X to a closed end of slot SLT may correspond to operating frequencies in the low frequency bands LB1-LB3. A length L3 from the feed point 202 toward an opposite of the direction X to an open end of the open slot SLT may correspond to operating frequencies in the medium frequency band MB. There is a length L4 from the feed point 202 toward the direction X to where the frequency-division circuit 201 is connected to the radiator 203. In one embodiment, the length L1 may be 57 millimeters, the width W may be 1.5 millimeters, the length L3 may be 25 millimeters, and the length L4 may be ranged from 2 millimeters to 5 millimeters.

FIG. 4A to FIG. 4E and FIG. 5A to FIG. 5D illustrate curves of efficiency of the tunable antenna module 20 based on various switching states of the impedance-tuning circuits MTHZ and MTHX in FIG. 3.

In FIG. 4A to FIG. 4E, the PTIC of the impedance-tuning circuits MTHZ is respectively fixed to a different value V1, V2, V3, V4 or V5 while the impedance-tuning circuit MTHX is switched to different states. The curve of efficiency of the tunable antenna module 20 is respectively denoted with a thin solid line, a thick solid line, a dashed line and a dotted line if the capacitor C1, C2, C3 or C4 of the impedance-tuning circuit MTHX is connected by the switch circuit SW. As can be seen from FIG. 4A to FIG. 4E, changing the states of the impedance-tuning circuit MTHX may adjust the impedance of the antenna 200 in the low frequency bands LB1-LB3 since the maximum efficiency of the tunable antenna module 20 in the low frequency bands LB1-LB3 are shifted corresponding to different states.

In FIG. 5A to FIG. 5D, the impedance-tuning circuit MTHX is fixed to connect one of the capacitor C1, C2, C3 and C4 while the PTIC of the impedance-tuning circuits MTHZ is switched to different states. The curves of efficiencies of the tunable antenna module 20 are respectively denoted with a thin solid line, a dotted line, a dashed line, a thick solid line and a dash-dot line if the PTIC of the impedance-tuning circuits MTHZ are tuned to different fixed value V1, V2, V3, V4 or V5. As can be seen from FIG. 5A to FIG. 5D, changing the states of the PTIC of the impedance-tuning circuits MTHZ may adjust the impedance of the antenna 200 in the low frequency bands LB1-LB3, the medium frequency band MB and a high band HB since the maximum efficiency of the tunable antenna module 20 in the low frequency bands LB1-LB3, the medium and high frequency bands MB and HB are shifted corresponding to different states.

Therefore, by changing the states of the PTIC of the impedance-tuning circuits MTHZ and the states of the capacitor C1, C2, C3 and C4 of the impedance-tuning circuit MTHX may effectively adjust the operating bands of the tunable antenna module 20 to support carrier aggregation.

Those skilled in the art may make modifications or alterations according to various embodiments of the present invention, which is not limited. For example, sizes regarding the open slot SLT and the antenna 200 (i.e. the lengths L1-L4 and the width W) may be adjusted according to practical requirements. The tunable circuit of the impedance-tuning circuit MTHX may be a combination of at least one of a varactor, a PTIC, a capacitor array, a tunable inductor, and a tuner. The switch circuit SW of the impedance-tuning circuit MTHX may be a diode, a transistor, a single pole single throw switch, a single pole multi throw switch, or a multi pole multi throw switch. The frequency-division circuit 201 may be a diplexer, a duplexer, a triplexer, a quadplexer, a low pass filter, a high pass filter, a band pass filter, a tunable diplexer, a tunable duplexer, a tunable triplexer, a tunable quadplexer, a tunable low pass filter, a tunable high pass filter, or a tunable band pass filter.

Please refer to FIG. 6A to FIG. 6E, which illustrate circuit structures of the frequency-division circuit 201 and one or more of the impedance-tuning circuits MTH1-MTHN according to various embodiments of the present invention. In FIG. 6A to FIG. 6E, the frequency-division circuit 201 may be a diplexer to have two ports LB_PT and HB_PT respectively connected with two impedance-tuning circuits, where the port LB_PT may form a signal path for the component frequencies in the low frequency bands LB1-LB3, and port HB_PT may form another signal path for the component frequencies in the medium frequency band MB or the high frequency band HB.

Figure 6C:
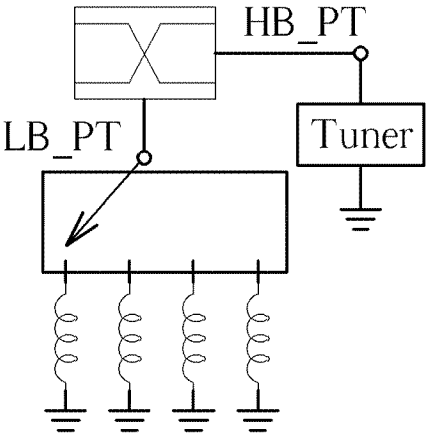
FIG. 6A to FIG. 6E illustrate circuit structures of the frequency-division circuit and one or more of the impedance-tuning circuits in FIG. 2 according to various embodiments of the present invention.
Figure 6B:
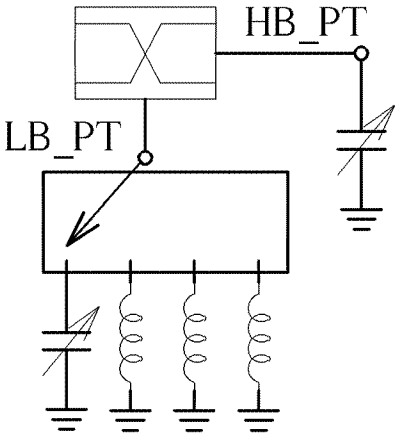
Figure 6A:
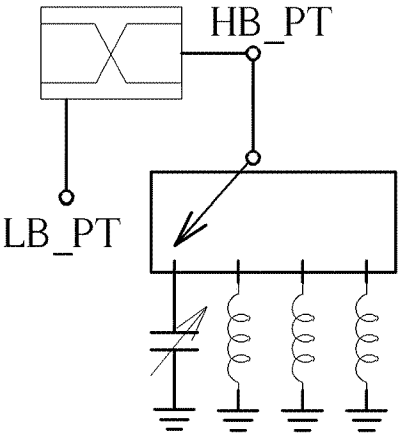
Figure 6D:
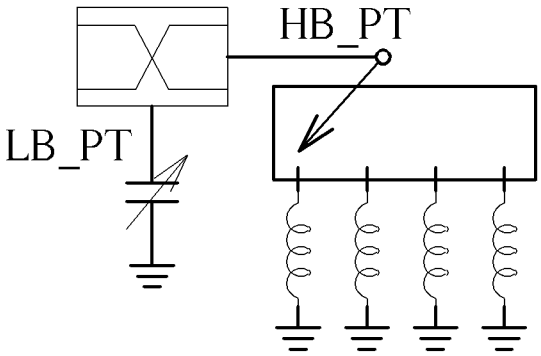
Figure 6E:
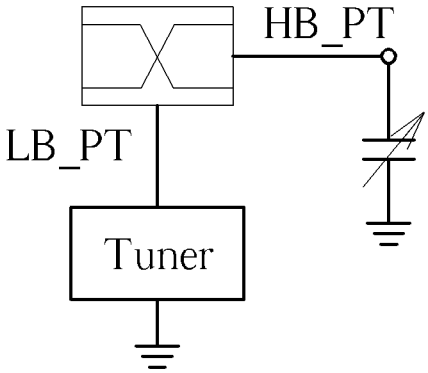

In FIG. 6A, the port LB_PT may be floating, while the port HB_PT may be connected to an impedance-tuning circuit composed of a switch, a varactor and an inductor array. In one embodiment, the port HB_PT may be connected to an impedance-tuning circuit, while the port HB_PT may be floating. In FIG. 6B, the port LB_PT may be connected to an impedance-tuning circuit composed of a switch, a varactor/PTIC and an inductor array, while the port HB_PT may be connected to a varactor/PTIC. In FIG. 6C, the port LB_PT may be connected to an impedance-tuning circuit composed of a switch and an inductor array, while the port HB_PT may be connected to a tuner. In FIG. 6D, the port LB_PT may be connected to a varactor/PTIC, while the port HB_PT may be connected to an impedance-tuning circuit composed of a switch and an inductor array. In FIG. 6E, the port LB_PT may be connected to a tuner, while the port HB_PT may be connected to a varactor/PTIC. Therefore, the present invention provides various embodiments to broaden a flexibility for adjusting the impedance of the antenna 200.

Figure 7:
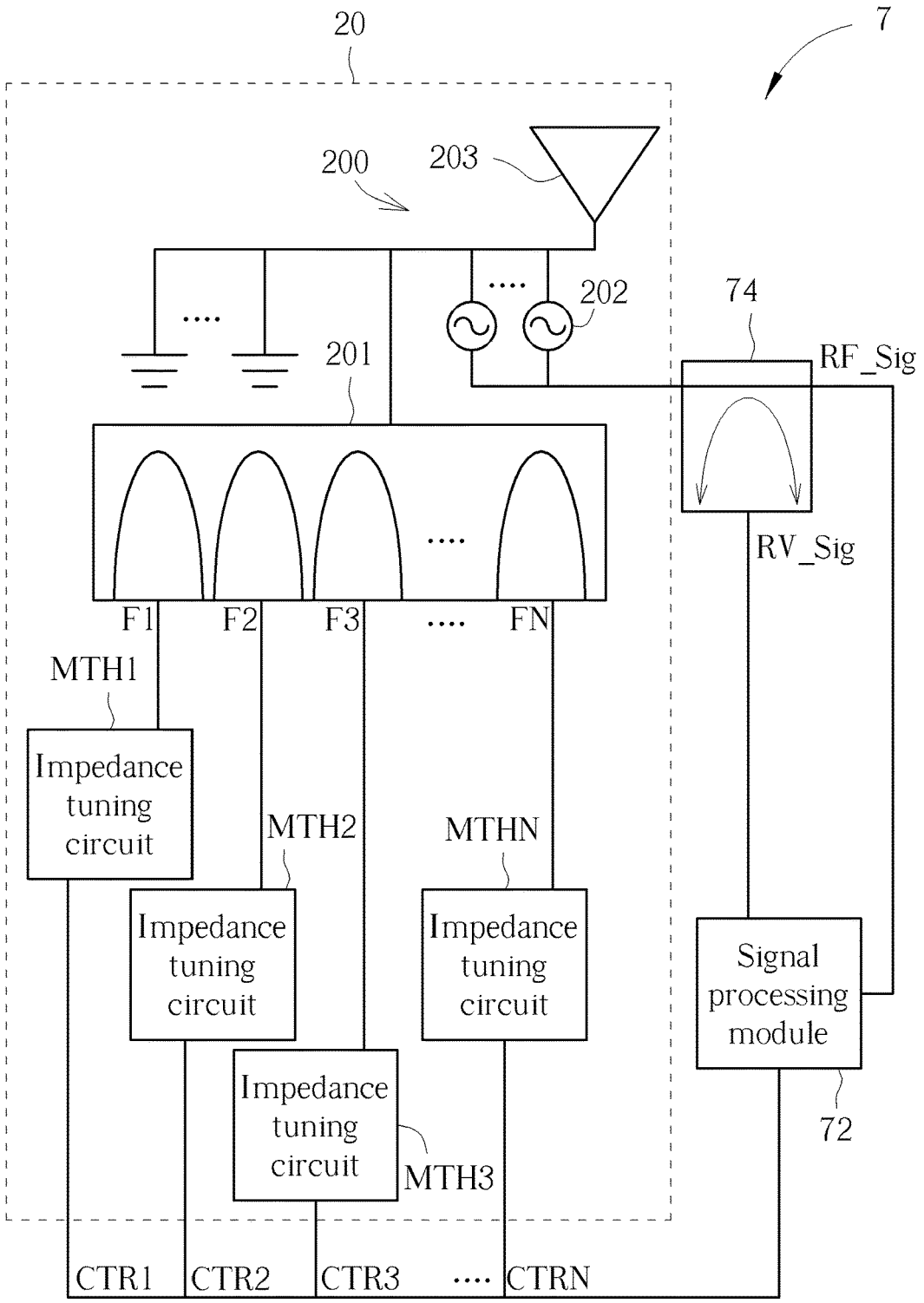
FIG. 7 is a functional diagram of a mobile device according to another embodiment of the present invention.

Please refer to FIG. 7, which is a functional diagram of a mobile device 7 according to another embodiment of the present invention. The mobile device 7 includes the tunable antenna module 20, a signal processing module 72 and a coupling device 74. The coupling device 74 may be coupled to the signal path of radio-frequency signal RF_sig (e.g., the signal path between the signal processing module 72 and the feed point 202) for coupling the radio-frequency signal RF_sig to generate a reverse signal RV_sig to the signal processing module 74.

In operation, the signal processing module 74 may perform a software algorithm according to the reverse signal RV_sig and the forward radio-frequency signal RF_sig to generate to the control signals CTR1-CTRN to the impedance-tuning circuits MTH1-MTHN. Therefore, the signal processing module 74 may adjust states of one or more of the impedance-tuning circuits MTH1-MTHN in real-time, which ensures the better antenna performance in real-time.

To sum up, the tunable antenna module of the present invention utilizes the frequency-division circuit to form signal paths for one or more of component frequencies of the radio-frequency signal between the radiator and the impedance-tuning circuits, such that the impedance associated with one or more of the component frequencies may be selectively adjusted by the impedance-tuning circuits. Therefore, operating frequency bands of the mobile device can be switched to support the modes CA1-CA3 and the non-CA mode to save production cost and stock management efforts, and the receiving signals of the antenna may not be interfered by harmonic spurs and noise signals, so as to reach a better signal-to-noise ratio.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A tunable antenna module for a mobile device, comprising:

an antenna comprising:

a feed point for feeding a radio-frequency signal; and a radiator coupled to the feed point for resonating the radio-frequency signal;

a frequency-division circuit coupled to the radiator for forming one or more signal paths for one or more of component frequencies of the radio-frequency signal;

one or more impedance-tuning circuits coupled to the frequency-division circuit for tuning an impedance of the antenna at one or more of the component frequencies of the radio-frequency signal; and a second impedance-tuning circuit coupled between the feed point and the radiator for tuning the impedance of the antenna at one or more of the component frequencies of the radio-frequency signal to match an impedance at a wanted band of a signal processing module of the mobile device and to mismatch from an impedance at an unwanted band of the signal processing module, wherein the second impedance-tuning circuit is a tuner or a passive tunable integrated circuit;

wherein the radiator, an open slot and a ground are formed in a metal cover of the mobile device;

wherein the impedance-tuning circuit comprises:

a tunable circuit coupled to a ground for tuning the impedance of the antenna at one or more of the component frequencies of the radio-frequency signal.

2. The tunable antenna module of claim 1, wherein the impedance-tuning circuit comprises:

a switch circuit coupled between the frequency-division circuit and the tunable circuit for connecting the tunable circuit with the frequency-division circuit or separating the tunable circuit from the frequency-division circuit according to a control signal generated by a signal processing module of the mobile device.

3. The tunable antenna module of claim 2, wherein the tunable circuit is a combination of at least one of a varactor, a passive tunable integrated circuit, a capacitor array, and a tunable inductor.

4. The tunable antenna module of claim 3, wherein the switch circuit is a diode, a transistor, a single pole single throw switch, or a single pole multi throw switch, or a multi pole multi throw switch.

5. The tunable antenna module of claim 1, wherein the impedance-tuning circuit is a tuner or a passive tunable integrated circuit.

6. The tunable antenna module of claim 1, wherein the frequency-division circuit is a diplexer, a duplexer, a triplexer, a quadplexer, a low pass filter, a high pass filter, a band pass filter, a tunable diplexer, a tunable duplexer, a tunable triplexer, a tunable quadplexer, a tunable low pass filter, a tunable high pass filter, or a tunable band pass filter.

7. The tunable antenna module of claim 1, wherein the radiator is extended along a first direction, the radiator includes one or more ground points for connecting the radiator with the ground formed on the metal cover, the open slot has a first length along the first direction and a width along a second direction, where the first direction is perpendicular to the second direction.

8. The tunable antenna module of claim 7, wherein a second length from where the ground point toward the first direction to a closed end of slot corresponds to a first operating frequency of the antenna, and a third length from the feed point toward an opposite of the first direction to an open end of the open slot corresponds to a second operating frequency of the antenna, wherein the first operating frequency is lower than the second operating frequency.

9. A mobile device, comprising:

a signal processing module for generating a radio-frequency signal; and a tunable antenna module coupled to the signal processing module, comprising:

an antenna comprising:

a feed point for feeding a radio-frequency signal; and a radiator coupled to the feed point for resonating the radio-frequency signal;

a frequency-division circuit coupled to the radiator for forming one or more signal paths for one or more of component frequencies of the radio-frequency signal;

one or more impedance-tuning circuits coupled to the frequency-division circuit for tuning an impedance of the antenna at one or more of the component frequencies of the radio-frequency signal; and a second impedance-tuning circuit coupled between the feed point and the radiator for tuning the impedance of the antenna at one or more of the component frequencies of the radio-frequency signal to match an impedance at a wanted band of a signal processing module of the mobile device and to mismatch from an impedance at an unwanted band of the signal processing module, wherein the second impedance-tuning circuit is a tuner or a passive tunable integrated circuit;

wherein the radiator, an open slot and a ground are formed in a metal cover of the mobile device;

wherein the impedance-tuning circuit comprises:

a tunable circuit coupled to a ground for tuning the impedance of the antenna at one or more of the component frequencies of the radio-frequency signal.

10. The mobile device of claim 9, wherein the impedance-tuning circuit comprises:

a switch circuit coupled between the frequency-division circuit and the tunable circuit for connecting the tunable circuit with the frequency-division circuit or separating the tunable circuit from the frequency-division circuit according to a control signal generated by a signal processing module of the mobile device.

11. The mobile device of claim 10, wherein the tunable circuit is a combination of at least one of a varactor, a passive tunable integrated circuit, a capacitor array, and a tunable inductor.

12. The mobile device of claim 11, wherein the switch circuit is a diode, a transistor, a single pole single throw switch, or a single pole multi throw switch.

13. The mobile device of claim 9, wherein the impedance-tuning circuit is a tuner or a passive tunable integrated circuit.

14. The mobile device of claim 9, wherein the frequency-division circuit is a diplexer, a duplexer, a triplexer, a quadplexer, a low pass filter, a high pass filter, a band pass filter, a tunable diplexer, a tunable duplexer, a tunable triplexer, a tunable quadplexer, a tunable low pass filter, a tunable high pass filter, or a tunable band pass filter.

15. The mobile device of claim 9, wherein the radiator is extended along a first direction, the radiator includes one or more ground points for connecting the radiator with the ground formed on the metal cover, the open slot has a first length along the first direction and a width along a second direction, where the first direction is perpendicular to the second direction.

16. The mobile device of claim 15, wherein a second length from where the ground point toward the first direction to a closed end of slot corresponds to a first operating frequency of the antenna, and a third length from the feed point toward an opposite of the first direction to an open end of the open slot corresponds to a second operating frequency of the antenna, wherein the first operating frequency is lower than the second operating frequency.

17. The mobile device of claim 9, further comprising:

a coupling device coupled between the signal processing module and the feed point for coupling the radio-frequency signal to generate a reverse signal to the signal processing module.

18. The mobile device of claim 17, wherein the signal processing module performs a software algorithm according to the reverse signal and the radio-frequency signal to generate at least one control signal to the first impedance-tuning circuit.

* * * * *